US006145493A

United States Patent [19]

Espey

[11] Patent Number: 6,145,493

[45] Date of Patent: Nov. 14, 2000

[54] FUEL GUIDANCE SYSTEM FOR A MULTICYLINDER INTERNAL COMBUSTION ENGINE HAVING INLET BORES FOR CONNECTOR PUMPS

[75] Inventor: Christoph Espey, Waiblingen, Germany

[73] Assignee: DaimlerChrysler AG, Stuttgart, Germany

[21] Appl. No.: 08/949,708

[22] Filed: Oct. 14, 1997

[30] Foreign Application Priority Data

Oct. 11, 1996 [DE] Germany ..... 196 41 952

[51] Int. Cl.[7] ..... F02M 37/04

[52] U.S. Cl. ..... 123/509; 123/456

[58] Field of Search ..... 123/509, 470, 123/456, 458, 468, 469

[56] References Cited

U.S. PATENT DOCUMENTS

| | | | |
|---|---|---|---|
| 3,779,225 | 12/1973 | Watson | 123/458 |
| 4,168,689 | 9/1979 | Parr . | |
| 4,244,520 | 1/1981 | Rathmayr . | |
| 4,459,963 | 7/1984 | Gross | 123/506 |
| 4,619,239 | 10/1986 | Wallenfang | 123/458 |
| 4,785,787 | 11/1988 | Riszk | 123/458 |
| 4,829,967 | 5/1989 | Nuti | 123/458 |
| 4,970,149 | 11/1990 | Kramer | 123/509 |
| 5,007,401 | 4/1991 | Grohn et al. . | |
| 5,297,524 | 3/1994 | Fransson et al. . | |
| 5,299,540 | 4/1994 | Fransson et al. . | |
| 5,411,001 | 5/1995 | Werner et al. . | |
| 5,419,298 | 5/1995 | Nolte | 123/509 |
| 5,479,903 | 1/1996 | Werner | 123/509 |
| 5,482,021 | 1/1996 | Roche | 123/456 |
| 5,533,485 | 7/1996 | Bronkal . | |
| 5,595,160 | 1/1997 | Matsumoto et al. . | |
| 5,692,477 | 12/1997 | Berger et al. . | |
| 5,884,608 | 3/1999 | Cooke | 123/495 |

FOREIGN PATENT DOCUMENTS

| | | |
|---|---|---|
| 0 374 422 | 6/1990 | European Pat. Off. . |
| 0 509 804 | 10/1992 | European Pat. Off. . |
| 0 784 154 | 7/1997 | European Pat. Off. . |
| 36 33 136 | 4/1988 | Germany . |
| 38 43 214 | 6/1990 | Germany . |
| 39 10 794 | 10/1990 | Germany . |
| 40 03 958 | 8/1991 | Germany . |
| 42 92 209 | 7/1993 | Germany . |
| 42 41 374 | 6/1994 | Germany . |
| 43 26 162 | 7/1994 | Germany . |
| 43 40 885 | 6/1995 | Germany . |
| 195 14 055 | 10/1995 | Germany . |
| WO 93/01408 | 1/1993 | WIPO . |

*Primary Examiner*—Carl S. Miller

*Attorney, Agent, or Firm*—Evenson, McKeown, Edwards & Lenahan, PLLC

[57] ABSTRACT

A fuel guidance system is provided for an internal combustion engine having in-line cylinders, inlet bores for connector pumps, high-pressure lines between the connector pumps and associated injection valves, as well as a fuel supply line that carries the fuel and communicates with the connector pumps. In the case of connector pumps having a solenoid-valve control, whose control valve controls the flow connection between the supply line and the high-pressure line, the supply line runs as a continuous fuel supply in the cylinder housing, intersecting the inlet bores, or being tangent to them, or running separately outside the cylinder housing. At least one further supply line that branches from the supply line leads to the low-pressure side of the control valve.

8 Claims, 4 Drawing Sheets

FUEL GUIDANCE SYSTEM FOR A MULTICYLINDER INTERNAL COMBUSTION ENGINE HAVING INLET BORES FOR CONNECTOR PUMPS

BACKGROUND AND SUMMARY OF THE INVENTION

This application claims the priority of German Application No. 196 41 952.2, the disclosure of which is expressly incorporated by reference herein.

The invention relates to a fuel guidance system for an internal combustion engine having in-line cylinders and inlet bores for connector pumps and, more particularly, to a fuel guidance system with high pressure lines between the connector pumps and associated injection valves, as well as with a supply line that carries the fuel, extends over the length of the cylinder housing, and is connected with the pumps.

German Patent document DE 43 26 162 C1 (which corresponds to U.S. Pat. No. 5,411,001) discloses a fuel guidance system arranged in the cylinder housing of a multicylinder internal combustion engine. A continuous lengthwise channel arranged next to the connector pumps in the cylinder housing functions as the fuel supply. This lengthwise channel is provided with branches that communicate with associated connector pumps in the form of projecting diagonal bores.

In addition, a through flow channel is provided as a fuel return. The through flow channel runs in connecting ribs projecting laterally from the row of cylinders, said ribs connecting adjacent receptacles for the connector pumps and projecting from the long side of the row of cylinders. The fuel then returns through the through flow channel as well as through annular intermediate spaces formed by annular grooves in the connector pumps.

The separate fuel supply and fuel return require that costly deep bores be drilled in the engine block.

There is therefore needed a fuel guidance system which achieves considerable simplification with respect to the manufacture of the cylinder housing or engine block.

These needs are met by a fuel guidance system for an internal combustion engine with in-line cylinders, with receiving bores for connector pumps, with high pressure lines between the connector pumps and associated injection valves, as well as with a supply line that carries the fuel, extends over the length of the cylinder housing, and is connected with the pumps. The supply line with the connector pumps and a solenoid valve control, whose control valve controls the flow connection between the supply line and the high-pressure line, runs as a continuous fuel supply line in the cylinder housing. The supply line intersects or is tangent to the inlet bores or runs separately outside the cylinder housing. At least one feed line that connects with the supply line leads to the low-pressure side of the control valve.

Advantageous improvements on the invention are described herein.

Eliminating a deep bore in the cylinder housing considerably reduces the cost of manufacture. The only deep bore remaining, as a continuous supply line for the fuel guidance system, also simplifies the cost of the connector pump , since the latter only requires a single annular chamber as the flow connection. In addition, the sealing problem in the vicinity of the pump is at least reduced by providing only one annular chamber.

The arrangement according to the invention of a continuous supply line that runs separately next to the connector pumps, said line therefore not being provided in the cylinder housing, has the advantage that it can be made of plastic and can be made in such fashion that this separate supply line can contain electrical leads to the connector pump, such as a cable harness and connectors, as well as an overflow valve, temperature sensor, fuel filter, etc. The supply line can be made as a direct attachment for the respective connector pump.

The supply line, made of plastic, damps the control peaks of the individual connector pumps. In this way, the influence of the connector pumps on one another is considerably reduced.

The cast, high-volume, through flow suction chamber, which, when viewed in cross section, has a width that approximately corresponds to the diameter of the connector pumps, improves the quality of injection. This is because the connector pumps influence one another to a lesser degree. It also results in greater stability of injection. Moreover, improved conditions are created for implementing pre-injection.

Other objects, advantages and novel features of the present invention will become apparent from the following detailed description of the invention when considered in conjunction with the accompanying drawings.

DETAILED DESCRIPTION OF THE DRAWINGS

Figure 1:
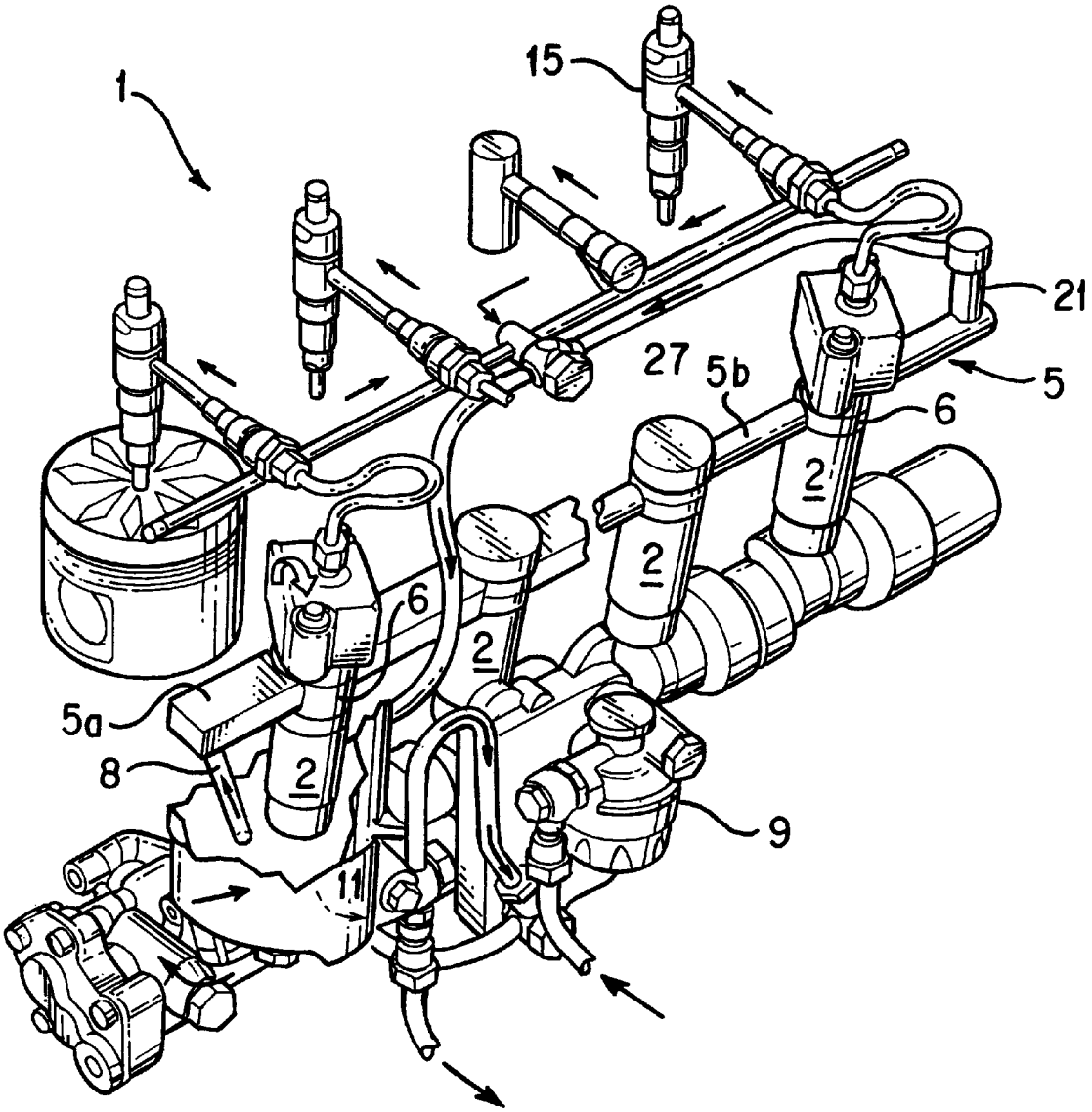
FIG. 1 is a perspective view of solenoid-controlled connector pumps with a supply line that runs continuously in the cylinder housing and intersects the inlet bores for all of the connector pumps, said supply line being shown as a through flow bore (left half of the figure) or as a cast through flow suction chamber (right half of the figure)

Referring to the Figures, an internal combustion engine 1 with in-line cylinders is equipped with solenoid-controlled connector pumps 2 plugged into inlet bores 3 formed in the cylinder housing 4.

A multicylinder internal combustion engine 1 is provided with a fuel guidance system that consists primarily of a supply line 5 for all of the connector pumps 2. The supply line 5 runs continuously in cylinder housing 4 (FIG. 3) and serves as a fuel supply. The pumps 2 also are arranged in line similarly to the cylinders.

The supply line 5 that passes through the cylinder housing 4 intersects all of the inlet bores 3, centrally or at least approximately centrally at the level of an annular groove 6 provided on each connector pump 2. The annular groove, together with a corresponding inlet bore 3, forms an annular chamber 7 in which supply line 5 terminates.

FIG. 1 shows two embodiments of the supply line 5 running centrally, namely supply line running in cylinder housing 4 as a cast through suction line 5*a* on the left side of the figure and as a through flow bore 5*b* on the right side of the figure.

Figure 3:
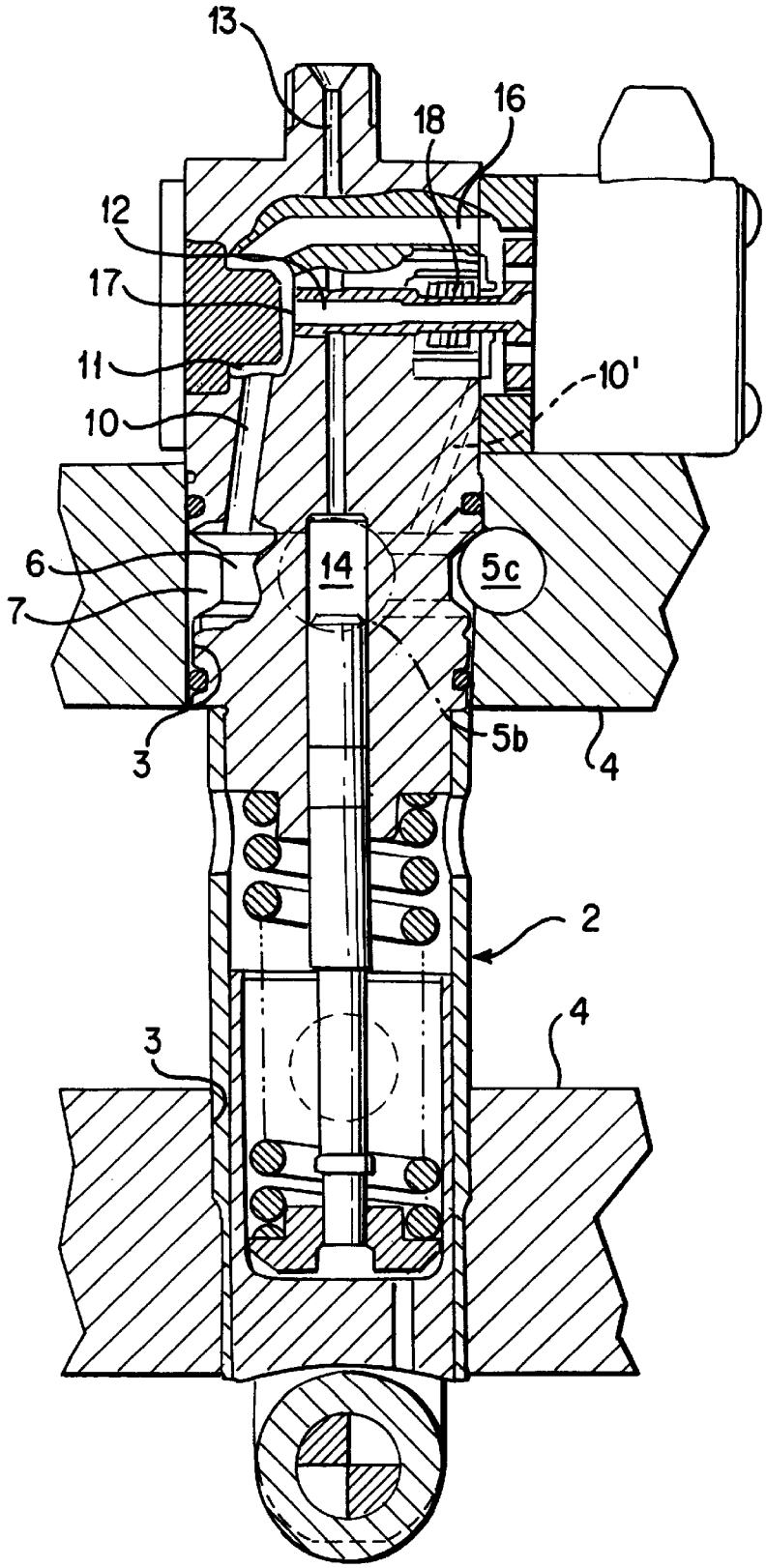
FIG. 3 is a longitudinal cross-sectional view of a connector pump having a supply line represented by the solid line, which is tangent to the inlet bores, or with a supply line represented by dot-dashed lines, that intersects the inlet bores centrally.

As showing in FIG. 3, the supply line 5, however, can also be arranged such that, as a through flow bore 5*c*, it is tangent to all receiving bores 3 at the level of the annular groove 6 of each connector pump 2.

Figure 2:
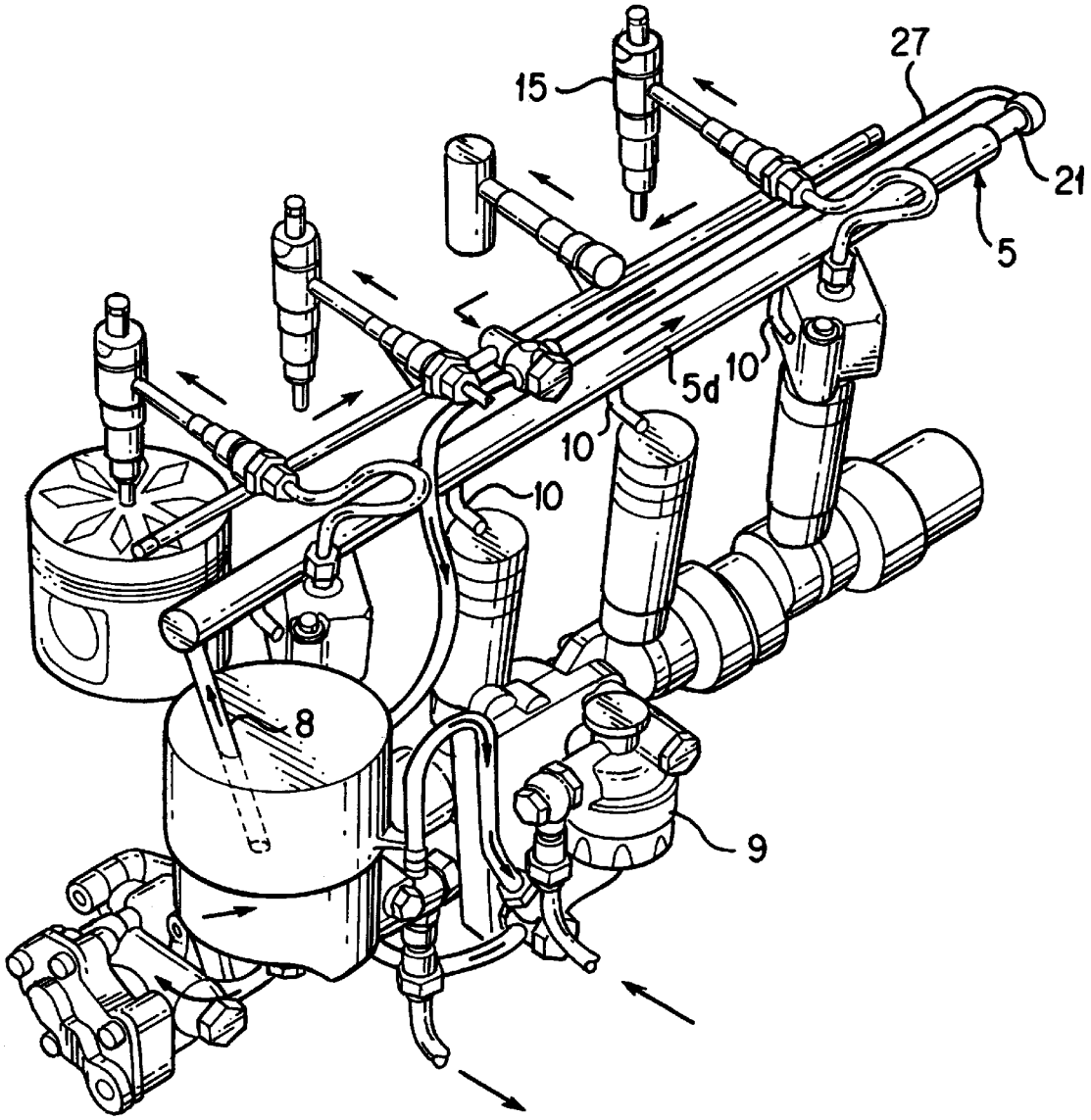
FIG. 2 is a perspective view of the supply line running separately outside the crankcase.

Referring to FIGS. 2 and 3, another fuel supply line 8 terminates at the inlet end of the supply line 5. Fuel is delivered by a delivery pump flow line through line 8 so as to enter the supply line 5. From the supply line 5, feed lines 10 associated with corresponding connector pumps 2 branch and lead to the low pressure side 11 of an electromagnetically operable control valve 12 located in head part 2*a* of connector pump 2.

Low-pressure side 11 can be connected with a high-pressure side by the control valve 12, said high-pressure side being connected in a constantly open manner as an injection or high-pressure line 13 firstly with pump working chamber 14 of connector pump 2 and, on the other hand, with an injection valve 15. As soon as control valve 12 opens, a flow connection to the low-pressure side 11 is created and injection is terminated.

Figure 4:
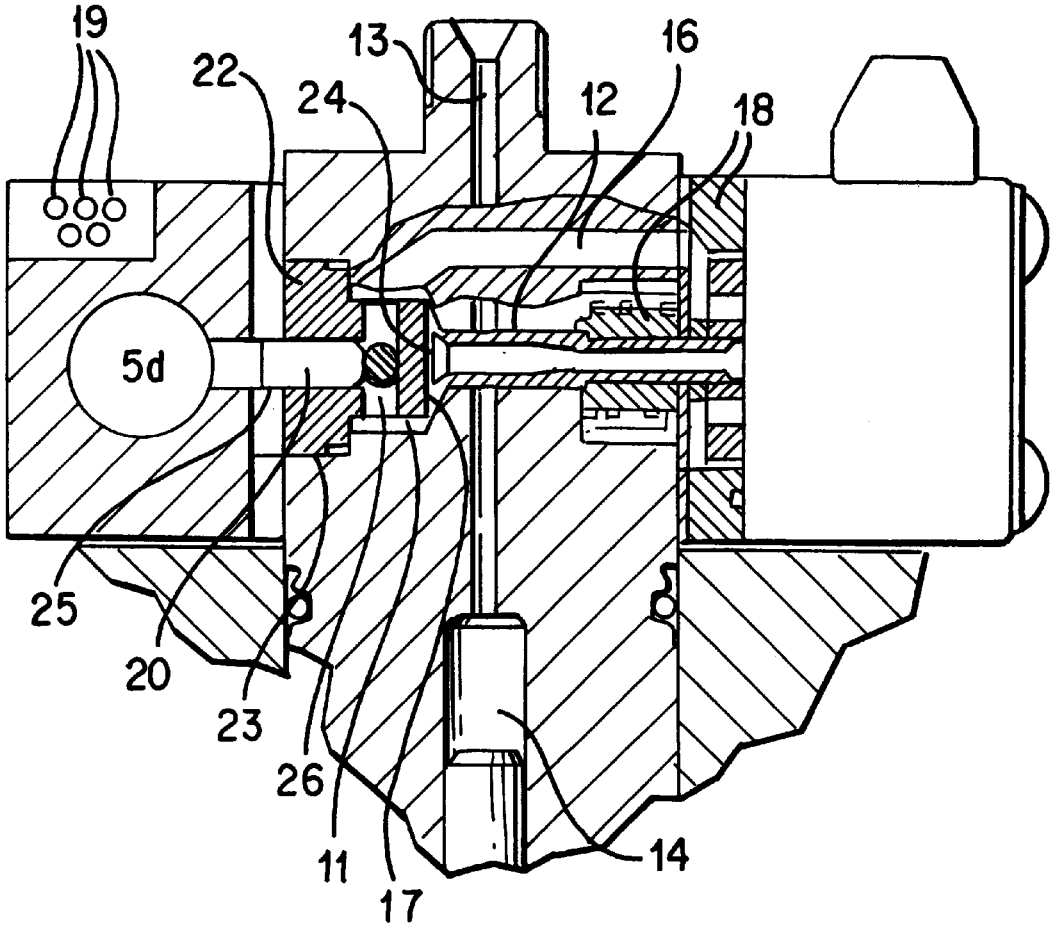
FIG. 4 illustrates the supply line as an attachment to the connector pump at the level of the solenoid valve.

Reference number 16 refers to a bypass line that connects the low-pressure side 11 at the front 17 of the control valve 12 with the back side 18 of this spring-loaded control valve 12 to equalize the pressure (FIGS. 3 and 4).

Instead of the bypass line 16, a second feed line 10' can be provided that produces a connection between the annular chamber 7 and the low-pressure back side 18 of control valve 12.

FIG. 2 shows a system in which the supply line 5 does not run in the cylinder housing 4, but extends externally as a distributor tube 5*b* over all of the connector pumps 2 and forms an attachment on the head part 2*a* of the connector pump 2 at the level of the control valve 12 (FIG. 4). Distributor tube 5*d* can be made of plastic. As a result, the control peaks of the individual connector pumps 2 can be damped and a quieter idle operation can be produced.

In addition, the distributor tube 5*d* that carries the fuel can be a receiving body for electrical leads or cables 19, sensors, fuel filter 20 (FIG. 4), overflow valve 21 (FIG. 2), et cetera.

According to FIG. 4, an insert 22 is placed in a stepped bore 23 in the head part 2*a* of the connector pump 2. The insert 22 in the open position of the control valve 12, serves as a stop 24 for the front side 17 of this control valve 12. The insert 22 is provided with a bore arrangement that is composed of a lengthwise bore 25 that runs centrally and is connected with the distributor 2, and a transverse bore 26 that branches off from the latter, with the transverse bore 26 terminating in the low pressure side 11.

In FIGS. 1 and 2, a return line that the overflow valve 21 and leads to a tank, not shown in greater detail, is labeled 27.

In an injection device in which no connector pumps are used, but rather pump-jet units are used, the supply line that serves as the fuel supply can be provided in accordance with the embodiments described above equipped with connector pumps, in or on the cylinder head.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A fuel guidance system for an internal combustion engine having in-line cylinders arranged in a cylinder housing, the fuel guidance system comprising:

inlet bores arranged in the cylinder housing;

connector pumps which are received in said inlet bores, said connector pumps being solenoid valve controlled;

high pressure lines extending between said connector pumps and associated injection valves of the internal combustion engine;

a supply line extending over a length of the cylinder housing and being connected with said connector pumps;

control valves associated with said connector pumps which control flow connections between said supply line and said high-pressure lines;

at least one feed line associated with a connector pump that connects said supply line and leads to a low-pressure side of an associated control valve;

wherein said supply line runs as a continuous fuel supply line either in said cylinder housing so as to one of intersect and tangentially connect with said inlet bores, or running separately outside said cylinder housing; and wherein said supply line is one of a through bore and a cast through flow suction chamber, said supply line intersecting said inlet bores at a level of an annular chamber formed by each of said inlet bores and connector pumps, at least in an approximately central manner.

2. A fuel guidance system for an internal combustion engine having in-line cylinders arranged in a cylinder housing, the fuel guidance system comprising:

inlet bores arranged in the cylinder housing;

connector pumps which are received in said inlet bores, said connector pumps being solenoid valve controlled;

high pressure lines extending between said connector pumps and associated injection valves of the internal combustion engine:

a supply line extending over a length of the cylinder housing and being connected with said connector pumps;

control valves associated with said connector pumps which control flow connections between said supply line and said high-pressure lines;

at least one feed line associated with a connector pump that connects said supply line and leads to a low-pressure side of an associated control valve;

wherein said supply line runs as a continuous fuel supply line either in said cylinder housing so as to one of intersect and tangentially connect with said inlet bores, or running separately outside said cylinder housing; and wherein said supply line is a through flow bore and is tangent to said inlet bores at a level of an annular chamber formed by each inlet bore and connector pump.

3. A fuel guidance system for an internal combustion engine having in-line cylinders arranged in a cylinder housing, the fuel guidance system comprising:

inlet bores arranged in the cylinder housing;

connector pumps which are received in said inlet bores. said connector pumps being solenoid valve controlled;

high pressure lines extending between said connector pumps and associated injection valves of the internal combustion engine;

a supply line extending over a length of the cylinder housing and being connected with said connector pumps;

control valves associated with said connector pumps which control flow connections between said supply line and said high-pressure lines;

at least one feed line associated with a connector pump that connects said supply line and leads to a low-pressure side of an associated control valve;

wherein said supply line runs as a continuous fuel supply line either in said cylinder housing so as to one of intersect and tangentially connect with said inlet bores, or running separately outside said cylinder housing; and wherein said supply line is a separate distributor tube mounted as an attachment on said connector pumps at a level of said control valves.

4. The fuel guidance system according to claim 3, wherein said separate distributor tube includes a receiving body portion for mounting additional engine components.

5. The fuel guidance system according to claim 4, wherein said additional engine components include at least one of electrical cables, an overflow valve, a fuel filter, and sensors.

6. A fuel guidance system for an internal combustion engine having in-line cylinders arranged in a cylinder housing, the fuel guidance system comprising:

inlet bores arranged in the cylinder housing;

connector pumps which are received in said inlet bores, said connector pumps being solenoid valve controlled;

high pressure lines extending between said connector pumps and associated injection valves of the internal combustion engine;

a supply line extending over a length of the cylinder housing and being connected with said connector pumps;

control valves associated with said connector pumps which control flow connections between said supply line and said high-pressure lines;

at least one feed line associated with a connector pump that connects said supply line and leads to a low-pressure side of an associated control valve;

wherein said supply line runs as a continuous fuel supply line either in said cylinder housing so as to one of intersect and tangentially connect with said inlet bores, or running separately outside said cylinder housing; and wherein said at least one feed line begins at an annular chamber formed by each of said inlet bores and connector pumps and terminates in a low-pressure side upstream from a respective control valve.

7. The fuel guidance system according to claim 1, wherein said at least one feed line begins at said an annular chamber and terminates in the low-pressure side upstream from a the control valve.

8. The fuel guidance system according to claim 2, wherein said at least one feed line begins at said an annular chamber and terminates in the low-pressure side upstream from a the control valve.

* * * * *